United States Patent [19]

Graham

[11] 4,050,349

[45] Sept. 27, 1977

[54] LIQUID PROPELLANT GUN (SCALING WITH MULTIPLE COMBUSTION ASSEMBLIES)

[75] Inventor: Alfred Rapp Graham, Burnt Hills, N.Y.

[73] Assignee: General Electric Company, Burlington, Vt.

[21] Appl. No.: 694,869

[22] Filed: June 10, 1976

[51] Int. Cl.[2] ..... F41F 1/04

[52] U.S. Cl. ..... 89/7

[58] Field of Search ..... 89/7, 9, 1 K; 417/349, 417/377, 381; 60/39.01

[56] References Cited

U.S. PATENT DOCUMENTS

| | | | |
|---|---|---|---|
| 2,981,153 | 4/1961 | Wilson et al. | 89/7 |
| 2,986,072 | 5/1961 | Hudson | 89/7 |
| 3,138,990 | 6/1964 | Jukes et al. | 89/7 |
| 3,160,064 | 12/1964 | Bell et al. | 89/7 X |
| 3,763,739 | 10/1973 | Tassie | 89/7 |
| 3,782,241 | 1/1974 | Ashley | 89/7 |

FOREIGN PATENT DOCUMENTS

| | | | |
|---|---|---|---|
| 2,427,139 | 12/1975 | United Kingdom | 89/7 |

*Primary Examiner*—David H. Brown
*Attorney, Agent, or Firm*—Bailin L. Kuch

[57] ABSTRACT

A liquid propellant gun utilizes a plurality of combustor assemblies or cells located about the periphery of the breech end of a gun barrel. Scaling to larger size guns may be achieved by using different numbers of identical combustor assemblies about the periphery of the bore. Further adjustments may be made by changing the stroke length. Such a standardized piston may be developed for a single cell gun where it may be perfected prior to adding pluralities of said cells to form larger guns. Due to each cell burning propellant progressively, each generates gas at a fixed rate so that for example eight cells supply eight times the rate of one cell. Hence scaling becomes a rational procedure.

2 Claims, 5 Drawing Figures

V
V
10
12
14
16
18
20
22
24
26
27
28
30
32
34
36
68
70
102
104
117
118
120
124
126
128
130
132
134
136

LIQUID PROPELLANT GUN (SCALING WITH MULTIPLE COMBUSTION ASSEMBLIES)

BACKGROUND OF THE INVENTION

1. Field of the Invention

This invention relates to liquid propellant guns utilizing a differential piston to provide continued or regenerative injection of propellant into the combustion chambers after initial ignition of propellant in the chamber.

2. Prior Art

Liquid propellant guns utilizing differential pistons to pump propellant into the combustion chamber during combustion are now well known. Early work is described in a Final Report of Nov. 19 53—31 Jan. 56 under contract DA-36-034-ORD-1504RD, Project TSI-47-8 by V. M. Barnes, Jr. et al which apparently in part corresponds to Jukes et al, U.S. Pat. No. 3,138,990 filed Oct. 9, 1961; in a report No. 17-2 of June 15, 1954 under contract NOrd-10448 by C. R. Foster et al; and in a Final Report of Sept. 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr. et al, U.S. Pat. No. 2,981,153, filed Nov. 14, 1952; C. M. Hudson, U.S. Pat. No. 2,986,072, filed Nov. 19, 1952; and E. J. Vass et al, U.S. Pat. No. 3,690,255 filed Oct. 1, 1970.

An object of this invention is to provide a rational scaling procedure through the use of a plurality of identical combustor assemblies utilizing a differential piston, such combustor assemblies being of a standardized design fully developed through test, therefore allowing any practical number of said combustor assemblies to supply gas to various size guns.

A feature of this invention is the provision that a standardized combustor assembly may be fully developed to a high degree of reliability before using these modules in various size multicell guns. Two or possibly three different size pistons may be required to cover a complete range of gun bores.

RELATED CASES

Subject matter directed to the details of the check valve disclosed herein is claimed in Ser. No. 694,867 filed by D. P. Tassie on June 10, 1976, and in Ser. No. 694,868 filed by A. R. Grahm on June 10, 1976. Subject matter directed to the details of the combustor assembly disclosed herein is claimed in Ser. No. 694,866 filed by A. R. Grahm on June 10, 1976.

BRIEF DESCRIPTION OF THE DRAWING

These and other objects, advantages and features of the invention will be apparent from the following specification thereof taken in conjunction with the accompanying drawing in which:

FIG. 5 is a transverse view in cross-section of a gun incorporating a plurality of the combustor assemblies of FIG. 1 taken along the folded plane V—V.

DESCRIPTION OF THE PREFERRED EMBODIMENT

Figures 1, 2, 3:
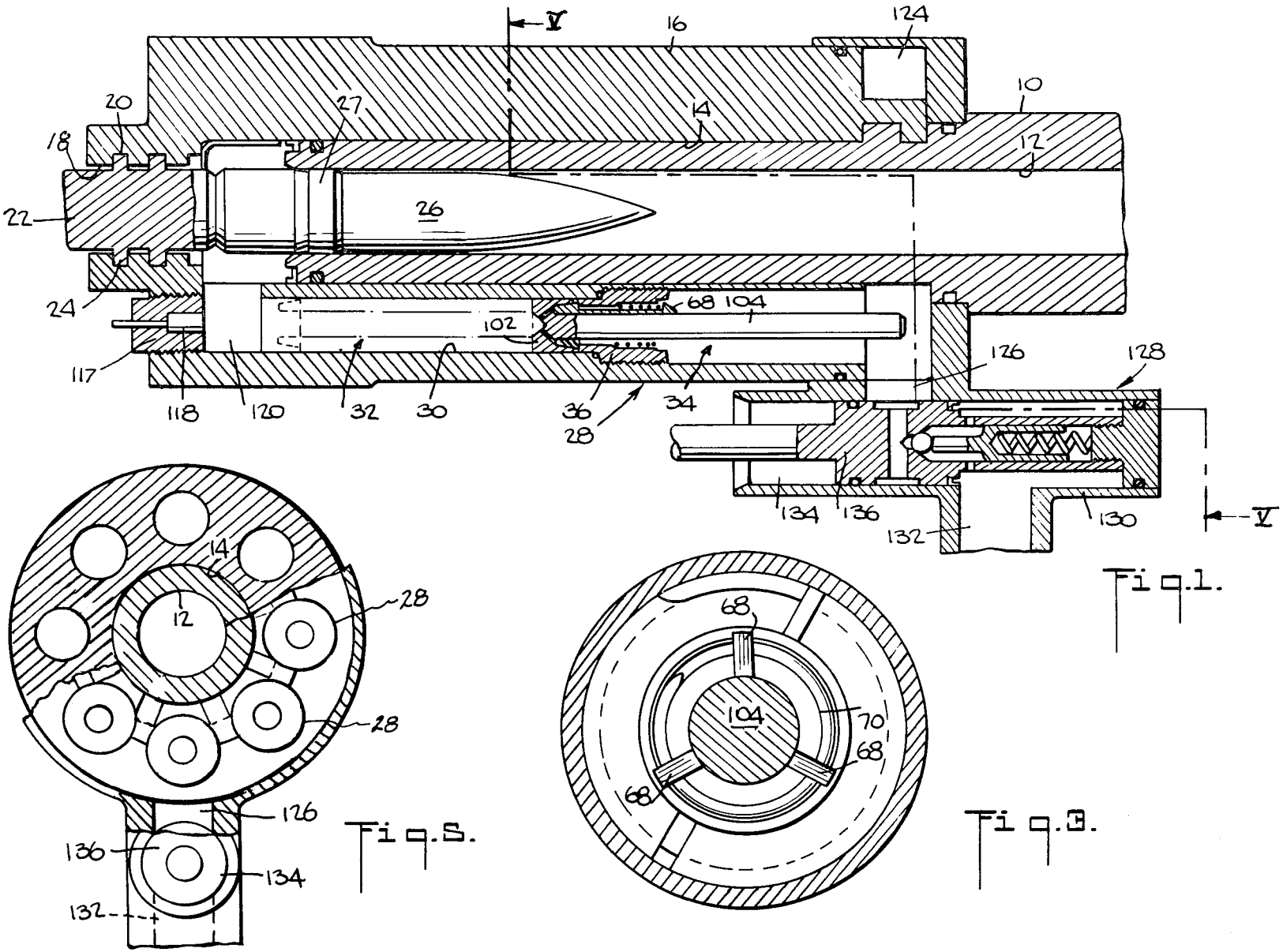
FIG. 1 is a detail view in longitudinal cross-section of a gun incorporating a combustor assembly embodying this invention.
FIG. 2 is an enlarged detail of FIG. 1 of the combustor assembly in the end of propellant injection mode.
FIG. 3 is a transverse view in cross-section taken along the plane III—III of FIG. 2.
Figure 2:
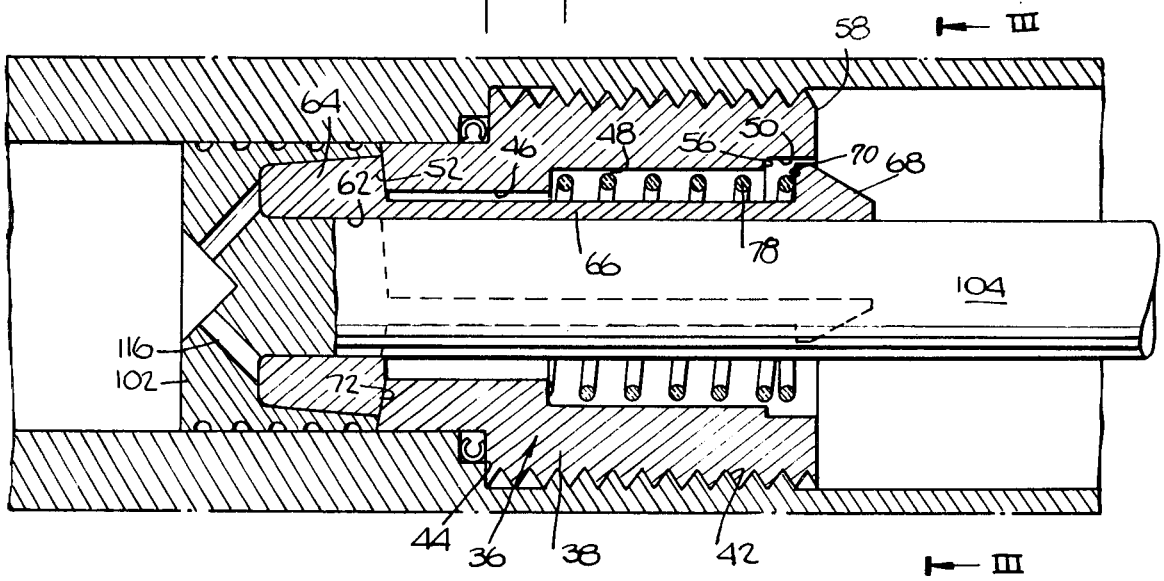

This invention, as shown in FIG. 1, may be incorporated in a liquid propellant gun of the type shown by D. P. Tassie in U.S. Pat. No. 3,763,739. However, the invention as here shown utilizes a monopropellant, although the regenerative piston system is applicable to bipropellants as well.

The gun system includes a gun barrel 10, having a gun bore 12, which is fixed in a forward bore 14 of a housing 16. The housing has an aft bore 18, with a plurality of locking recesses 20, which receives a gun bolt 22 having a plurality of locking lugs 24. A projectile 26 having a rotating band 27 may be inserted through the aft bore 18 and pushed forwardly into the gun bore 12 by the bolt 22, which bolt is then locked in and to the housing. The band 27 makes a gas tight seal with the bore.

Figure 4:
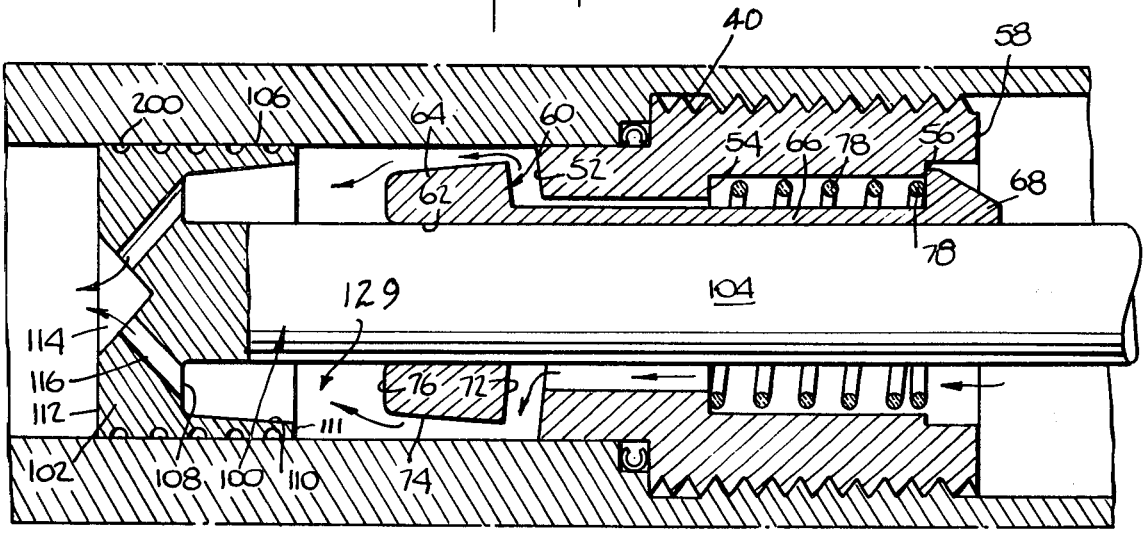
FIG. 4 is an enlarged detail of FIG. 1 of the combustor assembly in the propellant filling mode.

The housing 16 may have one, or as shown in FIG. 5, a plurality of combustor assemblies 28. As shown in FIGS. 1, 2 and 4, each combustor assembly includes a longitudinal bore 30 having a combustion chamber portion 32 and a liquid propellant inlet chamber portion 34. A coaxial check valve 36 is fixed in the bore 30 and includes an outer annular housing 38 which is externally threaded at 40 to engage threads 42 and a shoulder 44 in the bore 30, and has a longitudinal bore in three stepped portions: a portion 46 having the smallest diameter, a portion 48 having an intermediate diameter, and a portion 50 having the largest diameter. The housing 39 has a left face 52, an internal shoulder 54, an internal shoulder 56, and a right face 58. A sleeve 60 has a longitudinal bore 62, a left, truncated conical, annular portion 64, an intermediate portion provided by a plurality (here shown as three) of longitudinally extending, circumferentially spaced apart, beams 66, and a right portion provided a like plurality of heel, enlarged terminations 68 on each beam. The right portion has a left face 70 which will abut the shoulder 54, the left portion has a right face 72 which will mate with and will seal against the face 52, a conical, peripheral face 74, and a left face 76. A helical compression spring 78 is disposed between the shoulder 54 and face 70 and biases the sleeve 60 to the right.

A piston 100 has a head portion 102 which slides in the combustion chamber portion 32 and a stem portion 104 which slides in the bore 62 of the sleeve 60. The head portion has an L-ring longitudinal cross-section with an outer-peripheral surface 106 for sliding engagement with the wall of the chamber 32, a right transverse annular surface 108 which will mate with and will seal against the face 76, a right conical annular surface 110 which will mate with and will seal against the face 74, a transverse face 111 which will mate with and seal against the face 52, a left face 112 having a conical recess 114, and a plurality of bores 116 disposed in an annular row and interconnecting the face 108 with the recess 114.

The left or gas outlet end of the combustion chamber 30 of each combustor assembly 28 is closed by a plug 117 which carries a spark plug 118. A respective radial bore 120 communicates between the respective combustion chamber 30 and the left end of the bore 12 adjacent the aft end of the projectile 26, or projectile receiving chamber.

The right or inlet end of each liquid propellant inlet chamber portion 34 of each combustor assembly opens into an annular passageway or manifold 124, which in turn is open, at 126, to a propellant supply valve 128. The valve includes a housing 130 having an inlet port 132, a cylinder 134, and a spool 136. The spool may be cam controlled, as shown in U.S. Pat. No. 3,763,739, for synchronization with the other gun functions. Although a single tier of eight combustor assemblies is shown, other configurations such as double or triple tiers, and other convenient arrangements may be employed and are thus not limited to the single tier configuration of FIG. 3.

As shown in FIG. 1, before loading, the valve 128 is closed and the piston 100 is in its righthandmost position wherein it is nested with and sealed to the check valve 36. A projectile 26 is inserted into the gun bore 12 and the bolt 22 is closed and locked. The spool 136 is shifted to the left, opening the valve 128, admitting liquid propellant under pressure into the manifold 124. Propellant under pressure passes into the chamber portion 34 and into the longitudinal recesses between the beams 66, and applies pressure against the surface 72 of the portion 64 to shift the portion, against the bias of the spring 78, away from the surface 52, to permit the flow of liquid propellant around the portion 64 and against the surfaces 108 and 110 of the head 102 of the piston. This pressure provided by the incoming liquid propellant pushes the piston head to the left, creating and enlarging the available volume of a propellant pumping chamber portion 129 and decreasing the available volume of the combustion chamber portion. A small quantity of the liquid propellant passes through the bores 116 into the combustion chamber portion during this shifting of piston head, and thus a quantity of air which had entered when the bolt was open, plus this quantity of liquid propellant, are compressed and trapped in the combustion chamber. The liquid propellant is atomized as it passes through the bores, and the total quantity and the size of the droplets is a function, inter alia, of the diameter of the bores, the velocity of the piston and the pressure of the liquid propellant. When then piston head has reached its maximum excursion in compression, that is, leftmost travel, the liquid pressure in the pumping chamber portion 129 equals the liquid pressure in the supply manifold 124 and the supply chamber portion 34, and the spring 78 drives the sleeve 60 to the right, thereby closing the check valve 36. This quantity of compressed air and atomized propellant in the combustion chamber portion adjacent the sparkplug is predetermined and repeatable, and serves as a primer for the combustion of the main charge of propellant disposed in the supply chamber portion. Ignition of this primer is provided by the sparkplug. Ignition of the primer generates combustion gas whose pressure drives the piston to the right to increase the volume of the combustion chamber portion and to decrease the volume of the pumping chamber portion. The difference in areas of the two faces of the piston generates a difference in pressure in the two chambers so that liquid propellant is continually forced through the bores 116 into the combustion chamber at a controlled rate. The piston head is displaced continually to the right towards the closed check valve 36. As the piston head closes onto the annulus 74 of the check valve the remainder of the liquid propellant trapped therebetweeen provides an energy absorbing function and absorbs the energy of the moving piston head as it impacts against the check valve annulus, without any ullage. The interface surfaces 110 and 74 should be conical, approaching a cylinder, to provide maximum travel time for trapped fluid to absorb energy and pass through the bores, yet not so cylindrical as to trap liquid and prevent such liquid from reaching and passing through the bores.

The interface between the piston stem 104 and the bore 62 may be without seals, since any leakage from the pumping chamber portion will merely pass back into the supply chamber portion. The L-ring section 106 provides an effective seal between the hot gun gas in the combustion chamber and the relatively cold liquid in the pumping chamber portion, in that there is a difference in pressure on the piston head which provides for the flow of liquid propellant from the pumping chamber to the combustion chamber, which precludes any flow of gun gas from the combustion chamber to the pumping chamber.

To provide lubrication between the piston head 102 and the wall of the bore 32, a plurality of shallow, helical grooves 200 may be provided in the peripheral surface of the piston head, communicating from the left face 112 to the right face, adjacent 110. Liquid propellant will be forced through these apertures at the same time as through the bores 116, and will lubricate this interface. All lubricant passing into the combustion chamber portion will be in a swirl pattern, ensuring good mixing, and will be burned, either as primer, or as part of the main charge. A fresh supply of lubricant is provided during each firing cycle, and will clean out any particles which may lodge in the grooves.

Lubrication of the interface between the piston stem and the check valve sleeve is also provided by the liquid propellant.

The leakage propellant will act as a booster as well as a primer. The piston compresses air in front of its, and then creates a two-phase mixture in front of it, which on ignition, acts as a booster charge. A small booster charge results in a much faster initial chamber pressure rise which improves ballistic efficiency.

This scaling concept may be best understood by illustration. Assume that a combustor assembly or cell has been developed such that six such cells provide the necessary gas supply to fire a 3 inch gun. A 4 inch gun having the same charge to mass ratio would require exactly $(4 \text{ inch}/3 \text{ inch})^2 \times 6$ cells $= 10.67$ cells. One would select 10 cells and increase the storke length slightly to make up for the "0.67" not accounted for. Likewise a 5 inch gun would require 16 cells. As many cells may be used as desired, but at this point one might consider a second size cell to cover the 5 to 10 inch range. Clearly the charge to mass ratio may be changed for a given size gun bore by varying the number of cells or stroke length.

By developing two or three standard combustor assemblies it is possible to cover all gun sizes of interest. It is possible to develop such standard combustor assemblies to a high degree of reliability, and in an economical manner, since basic development will be accomplished in a single cell type fixture or gun. Each piston developed will employ a maximum length piston stem operating at the maximum piston velocity to be expected under any condition since this represents a limiting condition from the damping standpoint.

In order to employ such a piston for smaller propellant charges, the stroke length is changed by shortening the piston stem and supply chamber by equivalent amounts.

It is desirable to journal the pistons 100 for reciprocation along respective axes which are parallel to the axis of the gun bore, thereby precluding any side fictional loading of the pistons during gun recoil.

What is claimed is:

1. A liquid propellant gun comprising:

a gun barrel having a bore and a projectile receiving chamber, both disposed along a first longitudinal axis;

an annular row of a plurality of combustor assemblies, each respectively comprising a liquid propellant supply chamber, a combustion chamber and a regenerative piston for pumping liquid propellant from said supply chamber into said combustion chamber, each respectively disposed along a respective one of a like plurality of second longitudinal axes, said second longitudinal axes being uniformly spaced apart, parallel to each other and to said first longitudinal axis and uniformly spaced from said first longitudinal axis, each of said plurality of combustion chamber also including a respective one of a like plurality of igniter means; and conduit means coupling each of said combustion chambers to said projectile receiving chamber for transmitting combustion gas from each said combustion chamber to said projectile receiving chamber.

2. A gun according to claim 1 wherein:

said plurality of combustor assemblies is equal to or greater than three in number.

* * * * *

UNITED STATES PATENT OFFICE

CERTIFICATE OF CORRECTION

Patent No. 4,050,349 Dated Sept. 27, 1977

Inventor(s) Alfred Rapp Graham

It is certified that error appears in the above-identified patent and that said Letters Patent are hereby corrected as shown below:

Column 2, line 30 change "39" to --38--.
Column 3, line 39 change "then" to --the--.
Column 4, line 45 change "storke" to --stroke--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*